US006604358B2

(12) United States Patent
Dürr et al.

(10) Patent No.: US 6,604,358 B2
(45) Date of Patent: Aug. 12, 2003

(54) EXHAUST MANIFOLD

(75) Inventors: Gerd Dürr, Neustadt-Hambach (DE); Georg Georgs, Denkendorf (DE); Gerd Tiefenbacher, Stuttgart (DE); Hans A. Härle, Bopfingen-Baldern (DE)

(73) Assignee: DaimlerChrysler, AG, Stuttgart (DE)

( * ) Notice: Subject to any disclaimer, the term of this patent is extended or adjusted under 35 U.S.C. 154(b) by 0 days.

(21) Appl. No.: 10/156,330

(22) Filed: May 21, 2002

(65) Prior Publication Data

US 2002/0174650 A1 Nov. 28, 2002

(30) Foreign Application Priority Data

May 23, 2001 (DE) ..... 101 25 121

(51) Int. Cl.[7] ..... F01N 7/10

(52) U.S. Cl. ..... 60/323; 60/320; 60/322; 60/321

(58) Field of Search ..... 60/320, 321, 322, 60/323, 305, 272, 282

(56) References Cited

U.S. PATENT DOCUMENTS 4,537,027 A 8/1985 Harwood et al.
5,572,867 A * 11/1996 Kekkering et al. ..... 60/305
5,953,912 A * 9/1999 Kaiho et al. ..... 60/323
6,082,104 A * 7/2000 Hyakutake et al. ..... 60/323
6,155,046 A * 12/2000 Kato et al. ..... 60/323
6,247,552 B1 * 6/2001 Kovar et al. ..... 181/240

FOREIGN PATENT DOCUMENTS

| | | |
|---|---|---|
| DE | 100 01 287 | 2/2001 |
| EP | 0 671 551 | 9/1995 |
| EP | 0 709 557 | 5/1996 |
| EP | 0 765 994 | 4/1997 |
| EP | 0 849 445 | 6/1998 |

* cited by examiner

*Primary Examiner*—Thomas Denion
*Assistant Examiner*—Binh Tran
(74) *Attorney, Agent, or Firm*—Klaus J. Bach

(57) ABSTRACT

In an exhaust manifold to be mounted on a cylinder head of an internal combustion engine which cylinder head includes a plurality of exhaust passages, the exhaust manifold includes a gas collector housing with a mounting flange, a gas conducting duct arranged in spaced relationship within the gas collector housing and having a mounting collar, and a hold-down element mounted together with the flange onto the cylinder head and including a recess receiving the collar of the gas conducting duct for retaining the gas conducting duct in engagement with the cylinder head but permitting relative movement thereto.

15 Claims, 3 Drawing Sheets

EXHAUST MANIFOLD

BACKGROUND OF THE INVENTION

The invention relates to an exhaust manifold for mounting on a cylinder head of an internal combustion engine, the exhaust manifold including an exhaust duct disposed within a gas collector housing and in spaced relationship therefrom.

Such an exhaust manifold is disclosed in DE 100 01 287 A1. In this case, a sealing device is arranged between the exhaust-gas collector housing and the cylinder head, the sealing device permitting relative movements between these two components.

EP 0 709 557 A1 shows an exhaust manifold in which each exhaust tube is welded to a flange provided for screwing the exhaust manifold to the cylinder head. Starting from the cylinder head, the exhaust tubes open into a common collector tube which continues to the exhaust pipe.

However, this exhaust manifold is both heavy and expensive and, because of its large mass, removes relatively large amounts of heat from the exhaust gas flow passing therethrough. This reduces the temperature of the exhaust gas, which has the effect of reducing the efficiency of the catalytic converter arranged in the exhaust pipe, particularly during warm-up and in the warm-up phase of the internal combustion engine.

It has already been attempted to counteract this disadvantage, specifically for example, by means of an exhaust manifold according to EP 0 671 551 A1, in which a gas-conducting duct is arranged within a housing. It is disadvantageous here, however, that the weld joint between the outer casing of the exhaust manifold and a flange part connected to the cylinder head has a tendency to leak, and also that the inner tube is directly connected to the cylinder head.

EP 0 765 994 A1 discloses an exhaust manifold for an internal combustion engine with baffle plates welded into its housing, the baffle plates being intended to direct the exhaust gas flowing into the housing towards a discharge duct.

U.S. Pat. No. 4,537,027 describes a further exhaust manifold in which the exhaust gases of all the exhaust-gas bores are passed into a common housing.

However, in the case of the two last-mentioned exhaust manifolds, sealing problems occur due to the lack of gas-conducting duct, which has led to these conceptual solutions not having been adopted for mass production.

EP 0 849 445 A1 discloses a further exhaust manifold. In this case, a sealing device is provided which is of integral design with the exhaust-gas collector housing. However, this does not ensure tightness of the exhaust manifold. Also, the exhaust manifold, which is heated by the exhaust gases, may transfer its heat to the cylinder head and heat the latter in such a manner that damage to the engine may result.

The object of the present invention is to provide an exhaust manifold for mounting on a cylinder head of an internal combustion engine, which exhaust manifold effectively prevents exhaust gases from escaping from the exhaust system, and which is also cost-effective to produce and has a small mass.

SUMMARY OF THE INVENTION

In an exhaust manifold to be mounted on a cylinder head of an internal combustion engine which cylinder head includes a plurality of exhaust passages, the exhaust manifold includes a gas collector housing with a mounting flange, a gas conducting duct arranged within the gas collector housing in spaced relationship and having a mounting collar, and a hold-down element mounted together with the flange onto the cylinder head and including a recess receiving the collar of the gas conducting duct for retaining the gas conducting duct in engagement with the cylinder head but permitting relative movement thereto.

The fact that, according to the invention, the collar of the gas-conducting duct is engaged in the recess of the separate hold-down element permits the gas-collector duct to move so as to accommodate the effect of heat with respect to the sealing device and/or to the exhaust-gas collector housing. To permit such movements advantageously ensures the durability and therefore the operating strength of the exhaust manifold according to the invention and also contributes to isolating noise between the exhaust manifold and the cylinder head.

A shifting of the movements into the plane between the hold-down element and the encircling collar of the gas-conducting duct makes it possible to very readily isolate the gas-conducting duct and the exhaust-gas collector housing from each other in terms of vibration and thermally. Welding can be at least partially eliminated which reduces both the mass and the costs for the exhaust manifold.

The sealing device arranged between the exhaust-gas collector housing and the cylinder head ensures that the exhaust-gas collector housing is sealed with respect to the environment and furthermore permits movements between the exhaust-gas conducting duct and the cylinder head which may be caused, for example, by heat expansion. For this purpose, the recesses on the exhaust-gas collector housing, by way of which the exhaust-gas conducting duct can be connected to the cylinder head via bolts, are also appropriately designed, i.e. for example, as elongated holes.

The gas-conducting duct arranged within the exhaust-gas collector housing forms, together with the exhaust-gas collector housing, an exhaust manifold which is insulated by an air gap and removes, during engine warm-up, a comparatively small amount of heat from the exhaust gas because of the thin walls of the gas-conducting duct and, in particular, because of the air gap between the exhaust-gas collector housing and the gas-conducting duct. This may prevent a reduction in the exhaust-gas temperature and may improve the response and the efficiency of an exhaust-gas catalytic converter arranged downstream. Moreover, the use of the gas-conducting duct described permits a relatively inexpensive material to be used for the exhaust-gas collector housing, since only the gas-conducting duct itself is subjected to a high thermal load. This contributes to a lowering of the production costs for the exhaust manifold according to the invention.

It is particularly advantageous that all of the components of the exhaust manifold according to the invention can be produced by an inexpensive deep-drawing technique which is simple to master and which results in an altogether very inexpensive exhaust manifold. In this connection, the relatively expensive manufacture by internal high-pressure forming can be avoided.

Likewise advantageous is the very small overall size of the exhaust manifold, as a result of which only a very small amount of space is required for installing the exhaust manifold into the engine compartment of a motor vehicle. Furthermore, the exhaust manifold according to the invention has a very small mass, which constitutes a considerable advantage in modern engine construction.

Advantageous embodiments of the invention will become apparent from the description of a preferred embodiment of the invention shown by way of example only, in the accompanying drawings.

DESCRIPTION OF A PREFERRED EMBODIMENT

Figure 1:
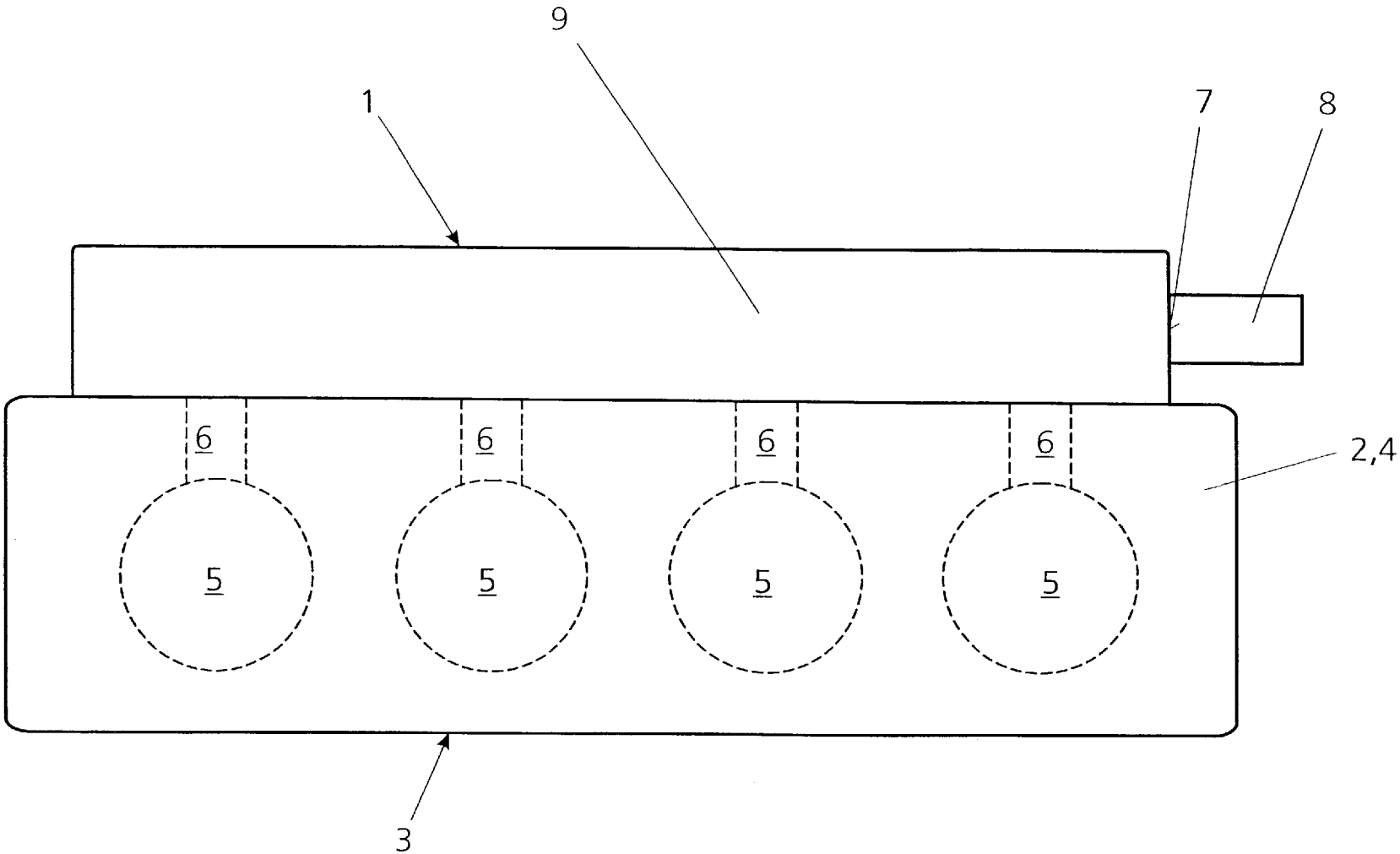
FIG. 1 shows a highly schematized internal combustion engine with an exhaust manifold mounted thereon.

As shown in FIG. 1, an exhaust manifold 1 which is mounted on a cylinder head 2 of an internal combustion engine 3 is illustrated in a highly schematic manner. The present embodiment concerns an inline internal combustion engine 3, which has just one cylinder bank 4 with four cylinders or combustion chambers 5 in this case. For V-type internal combustion engines 3, two cylinder banks 4 with associated cylinder heads 2 could, of course, be provided and a respective exhaust manifold 1 would then be mounted to each of the cylinder banks.

In the present case, the cylinder head 2 has four exhaust-gas passages 6 which lead away from the cylinders 5 and open into the exhaust manifold 1, so that the exhaust gas flows into the exhaust manifold 1. The exhaust manifold 1 is provided, on its side facing away from the internal combustion engine 3, with an opening 7 which can be situated in principle at any desired location and which is adjoined in a known manner by an exhaust pipe 8. In addition, an exhaust-gas catalytic converter (not illustrated) used for cleaning the exhaust gases can be situated in the exhaust pipe 8.

Figure 2:
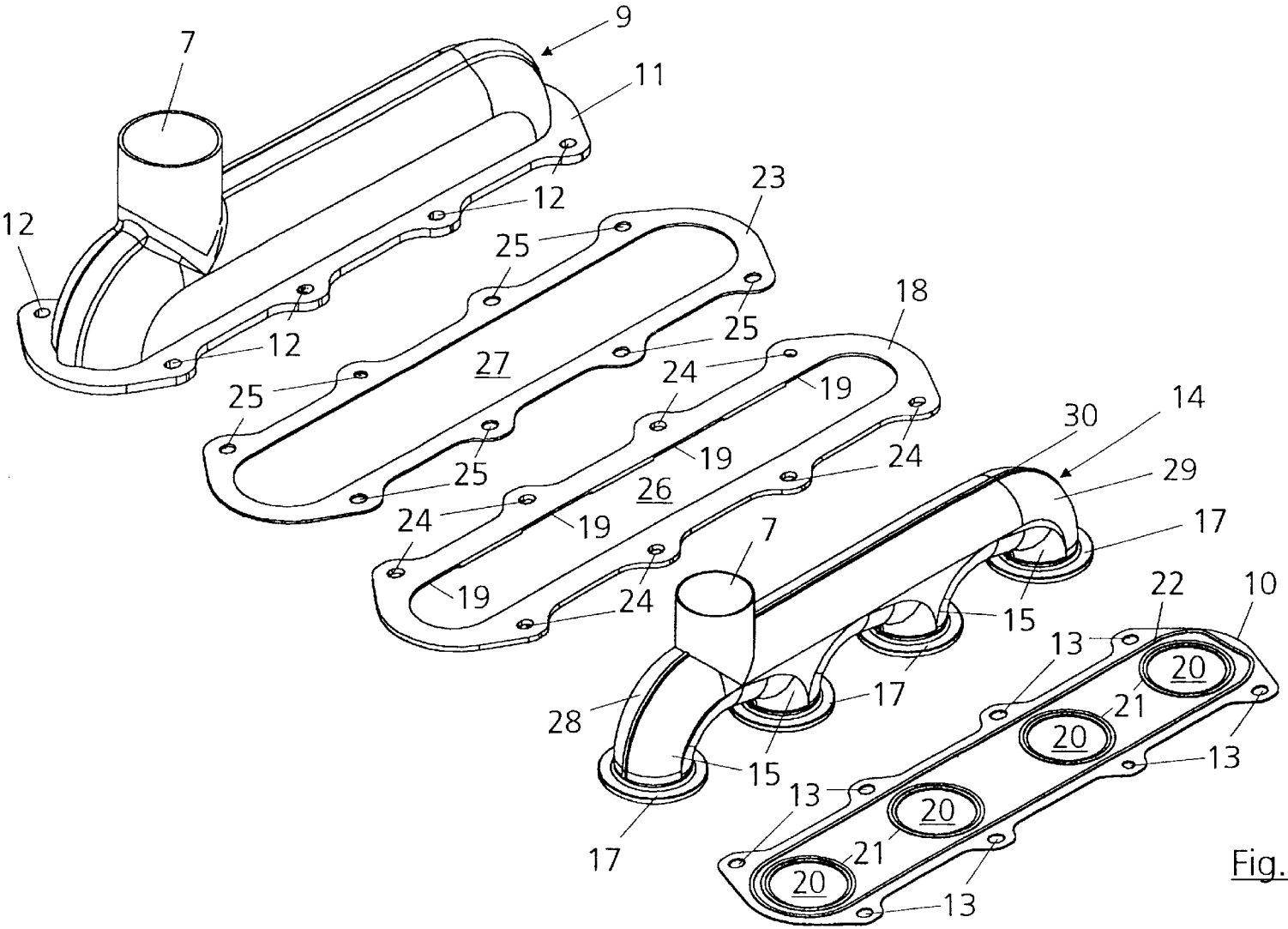
FIG. 2 is an exploded illustration of the exhaust manifold according to the invention.
Figure 3:
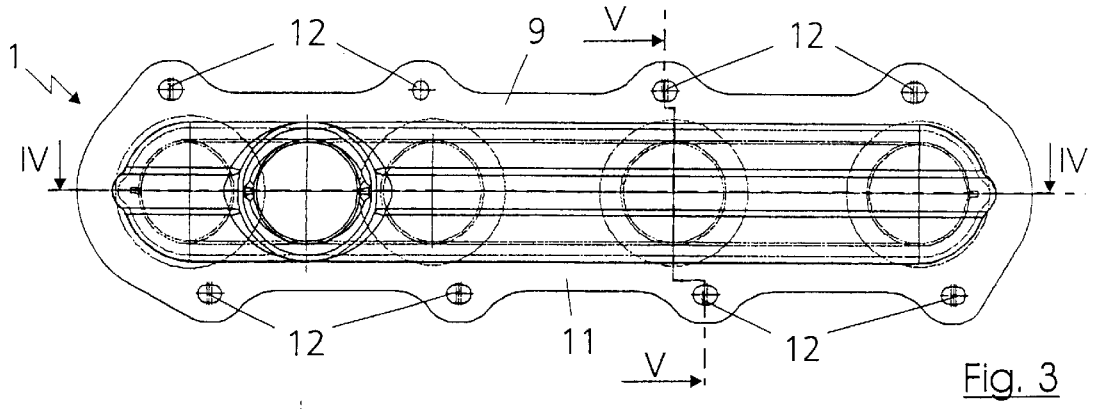
FIG. 3 is a plan view of the exhaust manifold shown in FIG. 2.

According to FIG. 2 which shows the exhaust manifold 1 in an exploded illustration, the exhaust manifold has an exhaust-gas collector housing 9 which receives the exhaust gases from the exhaust-gas passages 6 of the cylinder head 2. A sealing device 10 is situated between the exhaust-gas collector housing 9 and the cylinder head 2 (which is not illustrated in the following figures for reasons of clarity), to shield the cylinder head 2 from the high temperatures of the exhaust-gas collector housing 9. The sealing device consists, in the present case, of a temperature resistant metal.

The exhaust-gas collector housing 9 is surrounded over its entire circumference by an encircling collar 11, which includes openings 12, through which fastening means (not illustrated) extend, for example screws, with which the exhaust-gas collector housing 9 is mounted on the cylinder head 2. The sealing device 10 is likewise provided with openings 13, the shapes and locations of which essentially corresponds to those of the openings 12 of the exhaust-gas collector housing 9. In order to permit movements of the exhaust-gas collector housing 9 with respect to the sealing device 10 and therefore with respect to the cylinder head 2, the openings 12 and 13 are designed in the form of elongated holes. Since the material selected for the sealing device 10 is, on one hand, elastic and, on the other hand, has a low coefficient of friction because of a coating applied to it, with the fastening means tightened only up to a certain torque, the gas-conducting duct 14 can move with respect to the exhaust-gas collector housing 9 and the sealing device 10, within certain limits.

Disposed within the exhaust-gas collector housing 9 is the gas-conducting duct 14 from which individual pipe sections 15 extend to the respective exhaust-gas passages 6 to conduct the separate exhaust-gas flows from the individual exhaust-gas passages 6, to the gas duct 14. The positions of the pipes 15 correspond in each case at least approximately with the positions of the four exhaust-gas passages 6 of the cylinder head 2, with the result that the exhaust gases can be passed without any problem into the gas-conducting duct 14.

Figure 4:
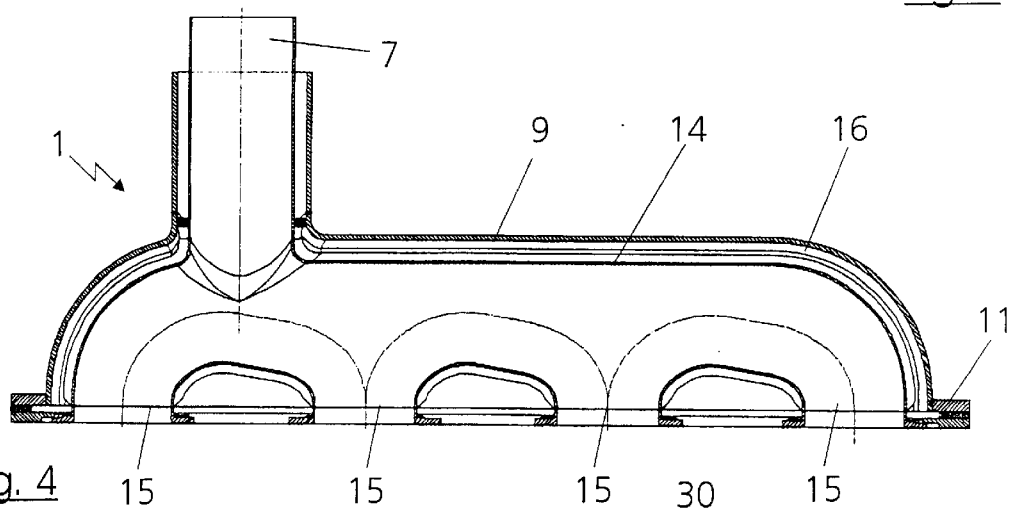
FIG. 4 shows a section according to the line IV—IV of FIG. 3.
Figure 5:
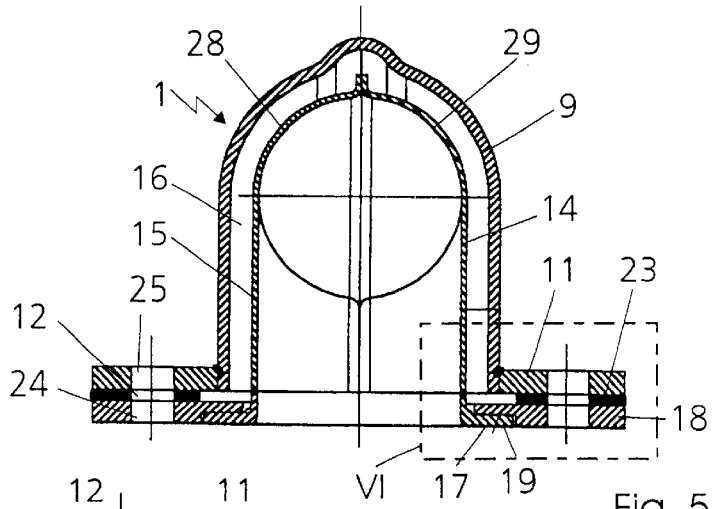
FIG. 5 is a sectional view taken along line V—V of FIG. 3.

As shown in FIG. 4, an air gap 16 is disposed between the gas-conducting duct 14 and the exhaust-gas collector housing 9 and separates the hot exhaust gas within the gas-conducting duct 14 from the cold ambient air. For this reason, the present embodiment of the exhaust manifold 1 is also referred to as an air gap insulated exhaust manifold.

The pipe sections 15 are each provided with an encircling collar 17 at their ends adjacent the cylinder head 2. The collars are engaged between the exhaust-gas collector housing 9 and the sealing device 10. A hold-down element 18 is arranged or engaged between the exhaust-gas collector housing 9 and the sealing device 10, the hold-down element 18 having, in the present case, four recesses 19. In each of the recesses 19, the respective encircling collar 17 of a pipe 15 is guided in such a manner that movements caused by the effect of heat are possible between the gas-conducting duct 14 and the sealing device 10 and/or the hold-down element 18. Of course, a hold-down element 18 which, instead of the four individual recesses 19, had a single, encircling recess 19, would also be conceivable.

All of the previously mentioned parts, such as, for example, the exhaust-gas collector housing 9 and the gas-conducting duct 14, can be produced relatively inexpensively by deep-drawing or similar forming processes, and complicated components produced by internal high-pressure forming or by similar costly processes can be omitted.

Figure 6:
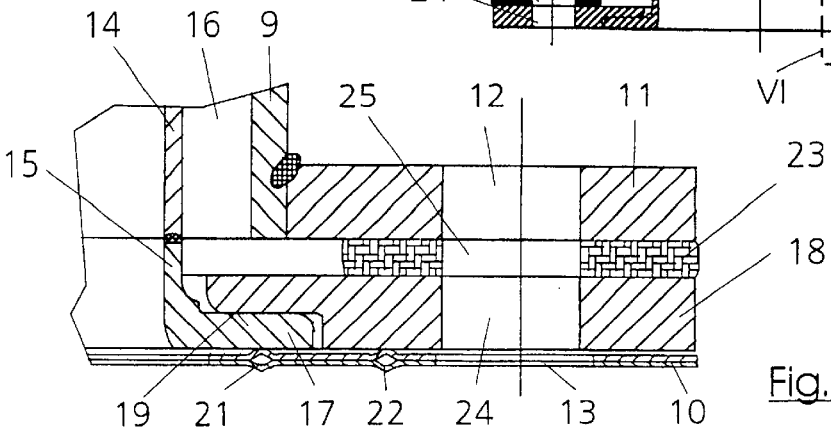
FIG. 6 is an enlarged illustration of the section enclosed by line VI of FIG. 5.

The sealing device 10 between the exhaust-gas collector housing 9 and the cylinder head 2 has four openings 20 corresponding to the exhaust passages 6, and is provided with beads 21 which, in each case, encircle the outside of the opening 20 and are in contact, on one side, with the cylinder head 2 and, on the other side, with the gas-conducting duct 14 and therefore seal these two parts relative to each other. A second bead 22 extends around the first beads 21 and bears, on the one hand, against the cylinder head 2 and, on the other hand, against the hold-down element 18 in order to seal them with respect to each other. This can be better seen in FIG. 6. In addition, the beads 21 and 22 produce an air gap between the cylinder head 2 and the sealing device 10, which gap isolates the exhaust manifold 1 to a certain extent from the cylinder head 2.

The gas-conducting duct 14 consists of a metal with high temperature stability, since it has to be able also to withstand relatively high exhaust-gas temperatures. Since this material is selected for the gas-conducting duct 14 and since the air gap 16 ensures insulation, the exhaust-gas collector housing 9 can consist of a relatively inexpensive structural steel or, for example if noise and/or strength problems occur, of cast iron. For the gas-conducting duct 14, which preferably has a thickness of approximately 0.8 mm, suitable material is, for example, the material number 1.4828 and for the exhaust-gas collector housing 9 having a thickness of approximately 2 mm, the material number 1.4512.

A further sealing device 23 is arranged between the hold-down element 18 and the exhaust-gas collector housing 9. This sealing device consists of a resilient substance, which is appropriate, in particular, for the purpose of noise elimination.

In the same manner as the sealing device 10 and the exhaust-gas collector housing 9, the hold-down element 18 has openings 24 for the passage of the fastening means. The same is also true for the sealing device 23 in which openings 25 are provided. The hold-down element 18 can thus be mounted by the fastening means fixedly with respect to the cylinder head 2 by way of the exhaust-gas collector housing 9 the openings 24 and 25 also being elongated holes.

Furthermore, both the hold-down element 18 and the sealing device 23 are provided in each case with a central opening 26 or 27 so that the sealing device 23 extends around all of the exhaust-gas bores 6.

The gas-conducting duct 14 is formed from two at least approximately identical half shells 28 and 29 which are formed as a single piece and are divided in the longitudinal direction of the gas-conducting duct 14, and in each case includes half of one of the pipes 15. The half shells are connected to each other along a weld seam 30. Of course, a connection of the half shells 28 and 29 by folding or by similar connection techniques is also possible.

What is claimed is:

1. An exhaust manifold mounting arrangement on a cylinder head of an internal combustion engine which cylinder head includes a plurality of exhaust passages for the discharge of exhaust gases from the cylinder head, said exhaust manifold including an exhaust gas collector housing, a gas conducting duct arranged within said exhaust gas collector housing in spaced relationship therefrom so as to form a gap between said exhaust gas collector housing and said gas conducting duct, said gas collector housing having a flange adjacent said cylinder head and said gas conducting duct having a collar at its end adjacent the cylinder head, a hold-down element arranged between the flange of said gas collector housing and said cylinder head and including a recess in which the collar of said gas conducting duct is engaged, and a sealing device disposed between said hold-down element and said collar at one side and said cylinder head on the other side, and fastening means extending through said flange and said hold-down element for firmly mounting said gas collector housing together with said hold-down element and said sealing device to said cylinder head while permitting limited movement of said collar relative thereto in order to provide for heat expansion of said gas conducting duct, which is subjected to high temperatures during engine operation.

2. An exhaust manifold according to claim 1, wherein individual pipe sections extend from the gas-conducting duct to the respective exhaust-gas passages.

3. An exhaust manifold according to claim 2, wherein said pipe sections are provided, on their side facing the cylinder head, with encircling collars which are engaged individually between the respective hold-down elements and the sealing device.

4. An exhaust manifold according to claim 2, wherein the gas-conducting duct consists of two at least approximately identical half shells, which are divided in the longitudinal direction of the gas-conducting duct and each forms half of the gas conducting duct and pipe sections.

5. An exhaust manifold according to claim 4, wherein said two half shells are joined to each other by one of folding and welding.

6. An exhaust manifold according to claim 1, wherein said hold-down element provided between the exhaust-gas collector housing and the sealing device has an opening which extends around all of the exhaust-gas passages.

7. An exhaust manifold according to claim 6, wherein individual recesses for the respective collars of the respective pipe sections are arranged in the region of the opening of the hold-down element.

8. An exhaust manifold according to claim 1, wherein a further sealing device is arranged between the hold-down element and the exhaust-gas collector housing flange.

9. An exhaust manifold according to claim 8, wherein the sealing device consists of a resilient material.

10. An exhaust manifold according to claim 1, wherein the exhaust-gas collector flange openings, the hold-down element and the sealing device include aligned openings for receiving fastening means.

11. An exhaust manifold according to claim 1, wherein the sealing device arranged between the exhaust-gas collector housing flange and the cylinder head consists of a highly temperature-resistant material.

12. An exhaust manifold according to claim 10, wherein the sealing device arranged between the exhaust-gas collector housing flange and the cylinder head has beads which encircle the outside of the respective exhaust passage openings and bear, on the one hand, against the cylinder head and, on the other hand, against the gas-conducting duct collar in order to provide a seal therebetween.

13. An exhaust manifold according to claim 12, wherein a second encircling bead extends around the first beads, said second bead bearing, on one hand, against the cylinder head and, on the other hand, against the hold-down element in order to provide a seal therebetween.

14. An exhaust manifold according to claim 1, wherein the exhaust-gas collector housing consists of structural steel.

15. An exhaust manifold according to claim 1, wherein the gas-conducting duct consists of a temperature-resistant metal.

* * * * *